United States Patent [19]

Vogt

[11] 4,296,712

[45] Oct. 27, 1981

[54] TWO-CHAMBER BOILER FOR BURNER FIRING AND SOLID FUEL FIRING

[75] Inventor: Alfred Vogt, Schaan, Liechtenstein

[73] Assignee: Hoval Interliz AG, Vaduz-Neugut, Liechtenstein

[21] Appl. No.: 134,613

[22] Filed: Mar. 27, 1980

[30] Foreign Application Priority Data

Apr. 3, 1979 [DE] Fed. Rep. of Germany ..... 2913205

[51] Int. Cl.[3] ..... F22B 31/04

[52] U.S. Cl. ..... 122/22; 122/2; 122/149

[58] Field of Search ..... 122/2, 149, 22, 7 B, 122/137, 211, 136 R

[56] References Cited

U.S. PATENT DOCUMENTS

| | | | |
|---|---|---|---|
| 1,061,503 | 5/1913 | Schaffer | 122/211 |
| 1,690,260 | 11/1928 | Wallis | 122/135 F |
| 3,223,074 | 12/1965 | Tanner et al. | 122/2 |
| 3,236,212 | 2/1966 | Ospelt | 122/136 R |
| 4,206,723 | 6/1980 | Kunkel | 122/2 |

FOREIGN PATENT DOCUMENTS

| | | | |
|---|---|---|---|
| 966236 | 8/1964 | United Kingdom | 122/2 |

*Primary Examiner*—Henry C. Yuen

*Attorney, Agent, or Firm*—Martin A. Farber

[57] ABSTRACT

A boiler provided with a burner chamber for a burner firing system and a combustion chamber for a solid fuel firing system, both chambers being arranged horizontally side by side in a common boiler water space enclosed by a horizontal outer boiler body. The combustion chamber has an approximately elliptical cross-section with vertical major diameter and the burner chamber has a round cross-section, the longitudinal center lines of both chambers being substantially at the same level. Both chambers are connected at their front ends with two separate horizontal ancillary heating passages extending axially parallel above the chambers within the boiler water space and having rectangular cross-sections with horizontal major cross-sectional dimensions and with internal comb-like ribbings. The outer boiler body is made of a metal sheet shaped in one piece by rolling into a hollow body of non-circular roundish cross-section.

6 Claims, 6 Drawing Figures

TWO-CHAMBER BOILER FOR BURNER FIRING AND SOLID FUEL FIRING

The invention relates to a two-chamber boiler in which a burner chamber for a burner firing system and a combustion chamber with a fire grate for a solid fuel firing system are arranged laterally side by side in a common boiler water region enclosed by a horizontal outer boiler body and in which from both chambers two separate horizontal ancillary heating passages lead in the boiler water region above the chambers to the flue gas collector of the boiler.

Two-chamber boilers of this kind are known for example from Utility Models Gebrauchsmuster No. 1,928,182, 6,937,720 and 7,621,611. The conventional style of construction of such boilers consists in that the outer boiler body enclosing the boiler water space has a rectangular cross-sectional form and is composed of flat walls, and in that in order to expediently exploit the internal space of the outer boiler body and to keep the boiler water volume small, correspondingly the burner chamber for the oil or gas firing and the combustion chamber for the coal or wood firing have a rectangular cross-section and are formed by flat walls. In comparison with the conventional style of construction of pure oil-fired boilers with a single cylindrical burner chamber and a cylindrical outer boiler body, this style of construction of the known two-chamber boiler, when produced as a steel boiler from sheet steel, has the following disadvantage. In order to achieve statically stable and pressure-proof walls of the two chambers and of the outer boiler body, thicker and therefore heavier and more expensive plates are necessary, which are contrary to the endeavour towards the minimum possible boiler weight and towards low material costs, pursued with the production of boilers from sheet steel, or that special reinforcements or connections, for example, in the form of ties or bolts, the arrangement and welding of which are very costly, are necessary on or between the walls of the two chambers and the outer boiler body. A further disadvantage of the known style of construction of two-chamber boilers consists in the unfavourable cross-sectional form of the chambers for the respective type of firing. This does not permit optimum burning away of the respective type of fuel, in order on the one hand in the case of oil firing, and on the other, especially in the case of wood firing, to achieve waste gas values, with respect to the soot content and the carbon monoxide content, such as are required by local regulations. Furthermore in the known two-chamber boilers one problem is the depositing of the combustion residues, occurring in burner firing and in solid fuel firing, upon the inner surface of the ancillary heating passages of the two chambers. This has a very disadvantageous effect upon the heat transfer to the boiler water and the efficiency of both types of firing and firing equipment of the boiler, and requires constant monitoring and cleaning of the ancillary heating passages.

The invention is therefore based upon the problem of producing a two-chamber boiler, which, in manufacturing can be produced from thin-walled, light steel sheets, without additional stiffenings or reinforcements, the requisite high static stability and pressure resistance, which can be formed, for the different boiler output sizes, with similar cross-sectional forms for the chambers and the outer boiler body and with the most space-conserving external dimensions possible, and from a combustion technology respect, with chamber forms most favorable for the respective type of firing, permits the achievement of optimum completion of burning of the fuel and optimum waste gas values and solves the problem of the ancillary heating passage cleaning and the deterioration of efficiency.

In accordance with the present invention this problem is solved primarily by the boiler configuration in which (a) The combustion chamber (2) comprises a horizontal hollow body closed at the rear end with an approximately elliptical cross-section with a vertical major diameter tapering downwards approximately conically to the fire grate, the cross-section below the fire grate merging into an ash space (4) of box shape;

(b) the burner chamber (11) has a horizontal round cylinder closed at the rear end, the longitudinal center line of which is substantially at the level of the longitudinal center line of the combustion chamber (2), the chambers each being connected at the forward end, closed by doors, with an ancillary heating passage (9, 15) of rectangular cross-section arranged axially parallel above the respective chambers in the boiler water region, the larger cross-sectional width of each passage extending horizontally and each passage being provided internally with a vertically directed ribbing (29) of comb-type cross-section; and (c) the outer boiler body (16) is made of a metal plate shaped in one piece by rolling into a hollow body and has a roundish cross-section differing from the circular form which comprises an upper, a lower and two lateral curve portions (17-20) with larger radius of curvature which merge into one another above the two chambers (2, 11) and beneath the burner chamber (11) by three transition curve portions (21-23) with smaller radius of curvature, the lower curve portion (18) and the curve portion (20) which is laterally adjacent the combustion chamber (2) terminating at the ash space (4) of the combustion chamber, while the height of the curve portion (19) laterally adjacent the burner chamber (11) is less than the height of the curve portion (20) laterally adjacent the combustion chamber.

By reason of these cross-sectional forms of the two chambers and of the outer boiler body, the boiler is composed of three hollow sheet metal bodies which possess curved circumferential walls which can be produced in one piece by a curvature of sheet metal, which result in a high ridigity to deformation and pressure resistance even when thin boiler plates are used and which render additional anchoring or reinforcement unnecessary. At the same time the characteristic cross-sectional shape of the outer boiler body results here, with space-conserving external dimensions of the boiler, in an internal space of the outer boiler body in which the chambers and ancillary heating passages, which are formed with a volume necessary for a specific boiler output value, have sufficient space, and yet on the other hand, in order that the quickest possible heating of the boiler may be achieved, no unnecessarily large utilized water-filled corners occur in the interior of the outer boiler body. The upright, approximately elliptical cross-sectional form of the combustion chamber, in addition to the pressure rigidity, produces a combustion chamber having a large filling level favorable for the combustion of soild fuels. It has proved especially advantageous for the achievement of equally favorable combustion conditions with so-called upper burning, in the case of firing with different fuels such as coke, coal or wood. By reason of the constant approximately conical taper of the approximately elliptical cross-section from the widest zone of the combustion chamber to the fire grate, the solid fuel always slides down in the grate, which is narrow in comparison with the cross-sectional width of the combustion chamber, even from the side, so that a concentrated glowing bed forms on the fire grate. For the re-ignition of the next fuel charge therefore a very shallow residual glowing layer suffices. On the other hand the occurrence of burning through the entire contents of the filling chamber, rendering partial load regulation impossible, which is otherwise often observed in the case of solid fuel boilers with upper burning, is prevented. Particularly in the case of wood firing, in accordance with a further embodiment feature according to the invention the arrangement to be described later with reference to the drawing of two lateral guide walls in the combustion chamber is of special advantageous effect. These walls receive the fuel charge between them and on their outer side, with the wall of the combustion chamber, form air passages for secondary air. The secondary air flows separately from the primary air flowing through the fuel charge, in the air passages, with simultaneous preheating, to the upper region of the combustion chamber above the fuel charge. On the one hand this division of the air entering through the air flap of the combustion chamber makes possible the achievement of better boiler regulation between the operation under full load and the operation under partial load, and on the other hand in fact in the case of wood firing, and in this case especially in operation under partial load when greater formation of incompletely burned gases occurs, the upper burning in combination with the pre-heated secondary air, achieves waste gases which fulfill the requirements concerning atmospheric hygiene and the requirements for an extraordinarily low carbon monoxide content.

With its cylindrical form, known per se in pure oil-fired boilers, the burner chamber has the cross-section most favorable for the burner firing especially with fuel oil. The arrangement of the cylindrical burner chamber, which as the more powerful of the two chambers has a smaller cross-sectional height than the approximately elliptical combustion chamber is not at the lowest point but approximately at mid-height of the boiler water region, that is with its longitudinal axis at the same level or approximately at the same level as the longitudinal axis of the combustion chamber. This arrangement has the advantage that the ordinary burner connected to the front end of the burner chamber does not lie low above the floor but is disposed at a more suitable height for burner maintenance above the floor, and that a sucking in of dust from the floor is also prevented.

Above the ancillary heating passage of the burner chamber sufficient space remains in the outer boiler body for the attachment of the boiler connections and thermostatic sensors to the outer boiler body in common in the water region above the burner chamber, as will be described in greater detail hereinafter. Beneath the burner chamber an unnecessarily large water region or space is avoided by the special cross-sectional shape of the outer boiler body, in that the height of the curve portion that is laterally adjacent the burner chamber is less than the height of the curve portion that is laterally adjacent the combustion chamber, whereby the lower curve portion rises obliquely from the ash space of the combustion chamber to the burner chamber.

For the space-saving dimensioning of the outer boiler body and for the production of the boiler by the use of the most uniform possible components it is advantageous for each chamber to have its own ancillary heating passage extending axially parallel through the boiler water region, in the form of a hollow section of box shape known per se with comb-type internal ribbing. The major or larger cross-sectional width of which extends horizontally in accordance with the featured arrangement, and here corresponds substantially to the diameter of the cylindrical burner chamber or the horizontal smaller diameter of the approximately elliptical combustion chamber, so that only one single hollow section of box shape is provided for each chamber and needs to be welded into the end walls of the boiler. Clean ancillary heating passages are of decisive importance for the achievement of maximum possible heat transfer values and boiler efficiencies. Although internally ribbed ancillary heating passages, especially with a narrow, comb-type internal ribbing for the achievement of maximum possible heat transfer area in a small space, cannot be cleaned of the combustion residues which deposit on the ribs in the case of oil-firing systems, and especially also in the burning of wood or lignite, or can be so cleaned only in an extremely troublesome manner by brushing, the invention nevertheless makes possible the use of these ancillary heating passages with comb-type internal ribbing, which per se are advantageous due to their compact construction style and extraordinarily high effectiveness, both for the burner chamber of a burner firing system and especially for the combustion chamber of a solid fuel firing system. In further development of the two-chamber boiler according to the invention this is achieved in the manner that the comb-type ribs of the ancillary heating passages have a height between 35 and 45 millimeters, preferably a height of 40 to 41 millimeters, and a rib thickness of about 2.5 millimeters from the rib base which is connected with the passage wall to the rib crest protruding into the passage cross-section. This dimensioning of the ribs achieves the object that when the ribs are subjected to the action either of the combustion gases of an oil-fired system in the burner chamber or of the practically almost equally hot combustion gases of a solid fuel firing system in the combustion chamber, on the one hand the heat absorption into the ribs on the rib surface, and on the other hand the heat outflow from the ribs through their rib cross-section into the water-cooled wall of the ancillary heating passages, are in such a ratio to one another that on the one hand a thermolytic self-cleaning effect of the ribs occurs and combustion residues which settle are disintegrated and burned, and thus the ribs remain clean, and that on the other hand the thermal durability limit of the rib material is not exceeded and a scaling or flaking of material occurring particularly at the hottest rib apex is avoided. Therefore the ancillary heating passages are advantageously formed in a manner in which they are made of an upper and a lower U-shaped half and are welded together and the two halves have ribs which are positioned opposite to one another in pairs, the vertical cross-sectional thickness of the box shaped ancillary heating passage corresponding substantially to twice the rib height. Tests with such ancillary heating passages have shown that with a rib thickness of 2.5 millimeters the most favorable rib height is 40 millimeters and a tolerance of the rib height of plus or minus 5 millimeters should not be exceeded. In the case of longer ribs a scaling occurs at the hottest rib apex. In the case of shorter ribs the ribs become too cold and self-cleaning no longer occurs. An adequate thermally conductive connection of the rib base with the wall of the ancillary heating passage is also of decisive importance here. Thus it has been found that in the case of ribs which are formed cohering together in pairs from an approximately V-shaped part and are connected at their common rib base with the wall of the ancillary heating passage by one common welded seam, the cross-section of the welded seam must be at least double the rib thickness, in order to obtain the ratio of heat absorption in the two ribs to the heat outflow from the two ribs through the common welded seam which is necessary to achieve the thermolytic self-cleaning and to avoid the danger of scaling.

With the above and other objects and advantages in view, the present invention will become more clearly understood in connection with the detailed description of a preferred embodiment, when considered with the accompanying drawings, of which:

FIG. 1 shown the boiler in a vertical cross-section;

Figure 1:
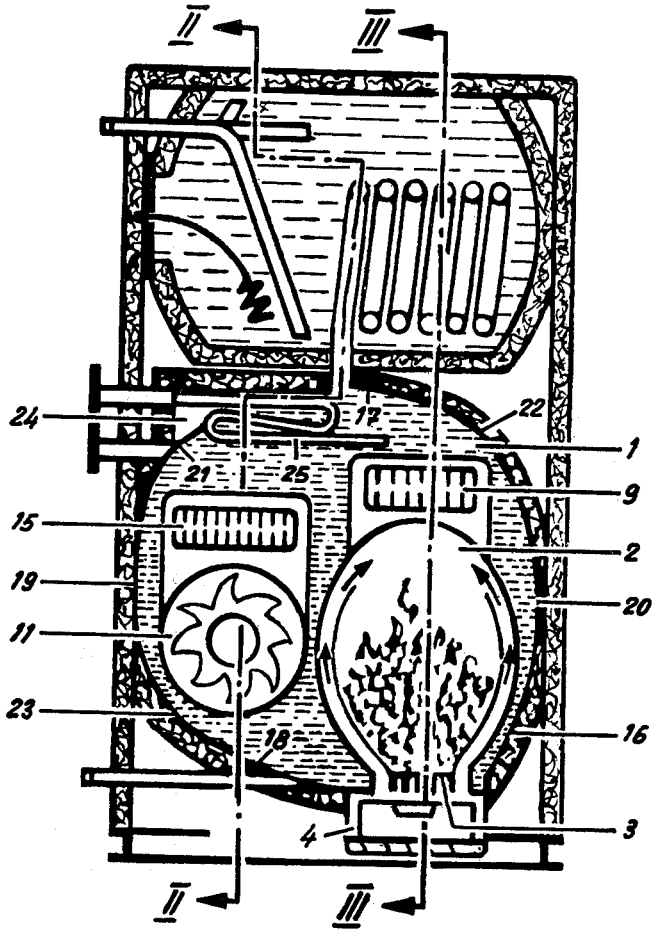
Figure 3:
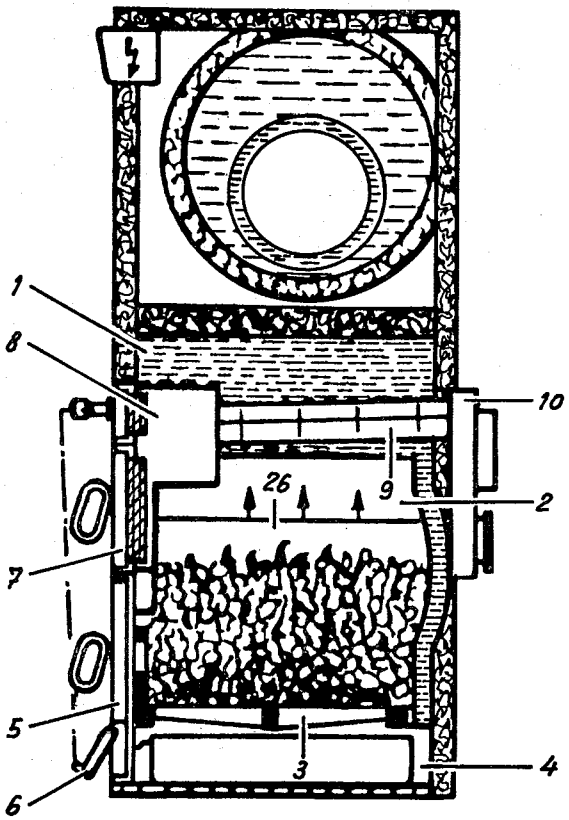
FIG. 3 shows a vertical longitudinal section along the line III-III in FIG. 1.
Figure 2:
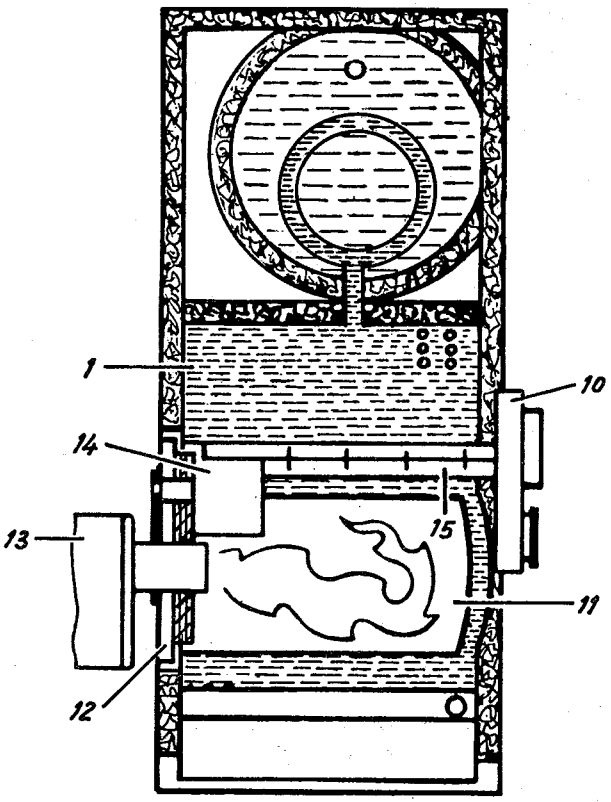
FIG. 2 shows a vertical longitudinal section along the line II-II in FIG. 1.

For the burning of solid fuels the boiler contains in its boiler water region 1 a combustion chamber 2 with a fire grate 3, which combustion chamber is formed by a horizontal hollow sheet metal body closed at the rear end. The combustion chamber 2 has a cross-section of approximately elliptical or inverted droplet form tapering downwards approximately conically to the grate 3. The maximum diameter of the cross-section extends vertically. The cross-section of the combustion chamber 2 merges beneath the fire grate 3 into an ash space 4 of box form. At the forward end the combustion chamber 2 is closed by an upper charging door 7 and by a lower door 5 of the ash space. The door 5 has an air flap 6. Behind the charging door 7 there is a water-cooled deflection chamber 8 by means of which the front end of the combustion chamber 2 is connected with an ancilliary heating passage 9 which lies axially parallel to and above the combustion chamber 2 in the boiler water region 1 and opens into a fuel gas collector 10 on the rear of the boiler. For the burning of liquid or gaseous fuels a burner chamber 11, formed by a horizontal sheet metal cylinder closed at the rear end, is located laterally adjacent the combustion chamber 2 in the boiler water region 1 and is closed at the front end by a boiler door 12 with a burner 13 and is offset upwardly in the boiler water region 1 so that its longitudinal center lines lies approximately at the level of the longitudinal center line of the combustion chamber 2 and thus the burner 13 is at an increased distance from the floor.

In back of the boiler door 12 there is a water-cooled deflection chamber 14 by means of which the front end of the burner chamber 11 is connected to a further, separate ancillary heating passage 15 which is arranged in the boiler water region 1 axially parallel to and above the burner chamber 11. The ancillary heating passage 15 opens into the flue gas collector 10 and there for the first time communicates with the ancillary heating passage 9 of the combustion chamber 2.

The boiler water region 1 is surrounded and bounded by an outer boiler body 16 which comprises a metal plate formed in one piece by rolling it into a hollow body. The outer boiler body 16 does not have an angular, circular or even elliptical cross-section, but a roundish cross-section comprising an upper curve portion 17, a lower curve portion 18 and two lateral curve portions 19 and 20 which have a larger radius of curvature. These curve portions merge into one another above the two chambers and beneath the burner chamber 11 via three transitional curve portions 21, 22 and 23 having a smaller radius of curvature. The lower curve portion 18 and the curve portion 20 lying laterally adjacent the combustion chamber 2 terminate at the ash space 4 beneath the combustion chamber 2. The height of the curve portion 21 laterally adjacent the burner chamber 11 is lower than the height of the curve portion 20 laterally adjacent the combustion chamber 2. Thus the lower curve portion 18, starting from the ash space 4, rises obliquely upwardly so that no unnecessarily large restricted space of the boiler water chamber or region 1 occurs beneath the burner chamber 11. Similarly to the round cross-sectional form of the burner chamber 11, the approximately elliptical cross-section form of the combustion chamber 2 and the cross-sectional form of the outer boiler body 16, which are composed of curved portions and transition curve portions, provide hollow sheet metal bodies which, even when thin boiler plates are used, possess a high rigidity to pressure and deformation and render additional reinforcement measures unnecessry, such as for example stiffening ribs or tie rods.

The approximately elliptical combustion chamber 2, having a large filling level, and its ancillary heating passage 9, make extensive use of the height of the boiler water region 1. The more powerful burner chamber 11 has a smaller cross-sectional height than of the elliptical combustion chamber 2 and together with its ancillary heating passage 15 requires less space in the boiler water region 1 than the combustion chamber 2 with its ancillary heating passage 9. Due to the upwardly offset arrangement of the burner chamber 11 in combination with the cross-sectional form of the outer boiler body 16, namely with the oblique rise of the lower curve portion 18, the volume of the boiler water to be heated below the burner chamber 11 is kept small, but on the other hand sufficient space remains above the ancillary heating passage 15 of the burner chamber 11 for the arrangement of practically all the connections of the boiler at this location of the boiler water chamber 1. For this purpose the outer boiler body 16 is provided in the region of the transition curve portion 21 with an opening and a hood 24 of approximately triangular cross-section set on the opening. The different boiler connectors and thermostatic sensors entering the boiler water region 1 are arranged on the laterally directed vertical wall of the hood. Into the hood there can for example also be installed a safety heat exchanger 25, occassionally required for boilers with solid fuel firing. The heat exchanger 25 must extend into the boiler water region 1. Likewise there is sufficient space available above the ancillary heating passage 15 of the burner chamber 11 for this heat exchanger 25. The hood has the advantage that the connectors, thermostatic sensors and other devices, which are desired or necessary from case to case, may already be arranged on it or welded into it before the hood 24 comes on to the boiler and is welded to the outer boiler body 16. Thus differently equipped hoods can be prefabricated separately and conveniently and otherwise the boiler can be of uniform formation and production and then, according to the country of destination and the existing regulations for boilers, that prefabricated hood which comprises the connectors and other equipment desired in the finished boiler can be selected and fitted.

In order to achieve a so-called upper burning of solid fuel in the combustion chamber 2 which is as complete as possible and also well regulatable between full load and partial load, especially in the case of the burning of wood, in the combustion chamber 2 on both sides there are arranged guide walls 26 which extend at a distance from the wall of the combustion chamber 2 upwardly from the fire grate 3 into the upper region of the combustion chamber 2. The guide walls 26 accommodate the fuel charge between them and a part of the air entering through the air flap 6 flows as primary air through the slots of the fire grate 3 between the two guide walls 26 and up into the fuel charge. The interspaces between the guide walls 26 and the wall of the combustion chamber 2 form air passages into which the other part of the air can enter as a secondary air through the fire grate slots laterally outside the guide walls 26, in order with simultaneous pre-heating in these interspaces to meet in the upper region of the combustion chamber 2 with the partially unburned gases and to bring about a complete combustion.

Figure 5:
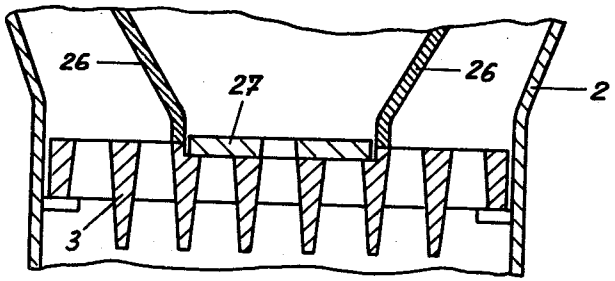
FIG. 5 shows, in enlarged representation, the lower end of the chamber for firing with solid fuel, visible in FIG. 1.
Figure 6:
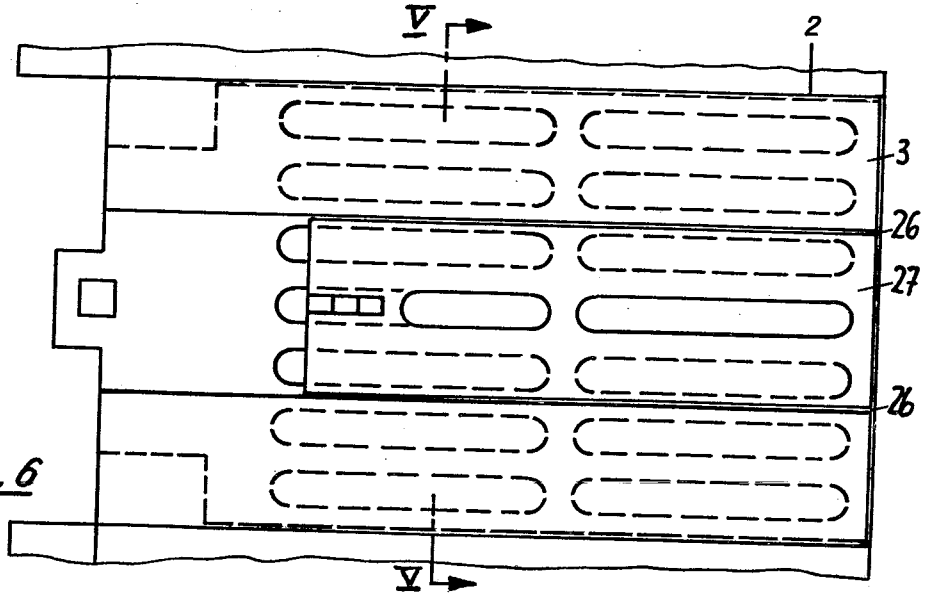
FIG. 6 is a plan view of the part of the boiler as shown in FIG. 5.

As shown in greater detail by FIGS. 5 and 6 the area of the fire grate 3 lying between the guide walls 26 is provided with a slide plate 27 which is slidable in the fire grate 3 in the longitudinal direction of the combustion chamber 2. The air slots of the fire grate 3 are partially closed by this slide plate 27 in every position of the slide plate. In part the air slots of the fire grate 3 are covered by the air slots of the slide plate 27 in such a manner that the passage cross-section of these air slots of the fire grate 3 can be enlarged or reduced by displacement of the slide plate 27. In this way the object is achieved that the entering quantity, varied at full load and also especially at partial load by means of the thermostatically controlled air flap 6, is divided in such a way that only one part flows as primary air through the fuel charge between the guide walls 26 and an adequate part flows as secondary air, with simultaneous pre-heating, through the two lateral air passages. Thus in fact in the case of wood firing, for which the guide walls and secondary air pre-heating passages are essential and important, waste gas values are achieved which satisfy the requirements existing at different places with respect to an extraordinarily low carbon monoxide content of the waste gases. If the slide plate 27 is completely withdrawn from the fire grate 3 and removed from the boiler so that all the air slots of the fire grate 3 are free, the boiler reaches its maximum solid fuel performance, for example, if coal or coke are to be burned. In this case a deliberate constriction of the primary air proportion and an increase of the secondary air proportion at full load or even at partial load is unnecessary. In operation with coal or coke it may also be possible to dispense with the guide walls 26 and the secondary air pre-heating passages so that the guide walls expediently can be formed in such a manner that for wood firing they can be pushed into the combustion chamber 2 and for coal or coke firing they can be removed from the combustion chamber.

The ancillary heating passage 9 of the combustion chamber 2 and the ancillary heating passage 15 of the burner chamber 11 uniformly have a rectangular cross-section, the larger cross-sectional width or thickness of which extends horizontally, while the horizontal cross-section width of the ancillary heating passage 15 is preferably approximately equal to the diameter of the burner chamber 11 and the horizontal cross-sectional width of the ancillary heating passage 9 is preferably smaller than the horizontal, smaller diameter of the elliptical combustion chamber 2.

Figure 4:
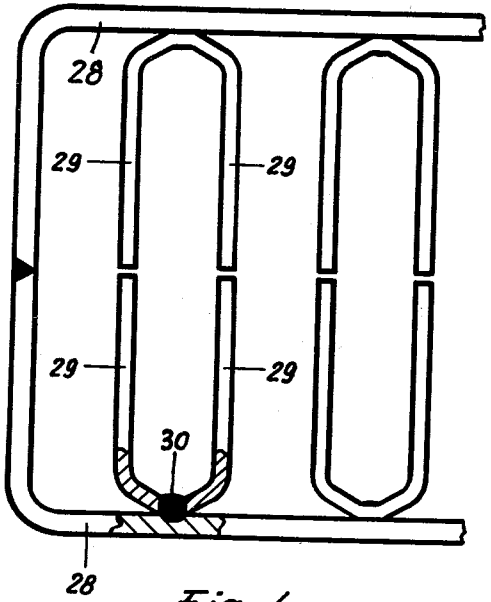
FIG. 4 shows, in enlarged representation, the ancillary heating passage of one of the two chambers which is visible in FIG. 1.

Both ancillary heating passages are internally provided with a ribbing of vertically directed ribs of comb-type cross-section. As shown by FIG. 4 the two ancillary heating passages, which are of box shapes are each welded together from an upper and lower U-shaped pipe half 28 and are provided with ribs 29 on the inside of the pipe halves. In each case two ribs hanging continuously together comprise a sheet metal strip bent into approximately U-form, which strip is connected in a thermally conductive manner by a single welded seam 30 to the pipe half. With a rib thickness of about 2.5 mm, the ribs 29 have a height of about 40 mm from their rib base, which is connected with the pipe half, to their rib apex protruding into the passage cross-section. This dimensioning of the ribs 29 has the effect that when subjected to the action of the combustion gases of the burner chamber, and also of the combustion chamber, the ribs which enter the ancillary heating passages with a temperature of about 600° to 700° C., do not become so hot that scaling of the rib material occurs especially at the rib apex. Instead on the other hand the ribs become so hot that combustion residues settling on the ribs are disintegrated and burned and a thermolytic self-cleaning effect of the ribs occurs. Thus the ancillary heating surface ribs remain free from sooting and their thermal absorption capacity and heat transfer performance are retained, so that regular cleaning of the ancillary heating passages are unnecessary for the purpose of achieving an economical fuel heat exploitation and high boiler efficiency.

To avoid the danger of scaling and to guarantee the thermolytic self-cleaning effect, the rib height should remain within a tolerance of plus or minus 5 mm. Furthermore the weld seam 30 common to two ribs should be twice as thick as the thickness of the ribs, that is it should amount to at least 5 mm. The ribs of the two pipe halves are opposite to one another in pairs and are disposed with their rib apex approximately in the plane of separation between the two pipe halves. Thus an ancillary heating passage is produced which, without exceeding of the permissible rib height, on the one hand has an internal ribbing reaching into the center of the cross-section or the middle of the gas flow, and on the other hand possesses a sufficiently large vertical cross-sectional height corresponding to twice the rib height, so that for each of the burner and combustion chambers a single ancillary heating passage suffices and only needs to be welded into the boiler plates at its ends.

While I have disclosed a preferred embodiment of my invention it is to be understood that this embodiment is given by example only and not in a limiting sense.

I claim:

1. A two-chamber boiler comprising a horizontal outer boiler body enclosing a common water region, a burner chamber adapted for a burner firing system and a combustion chamber adapted for a solid fuel firing system being arranged laterally adjacent one another in said outer boiler body in the common water region, two separate horizontal ancillary heating passages disposed in said water region, one of said passages respectively being disposed above said chambers respectively communicating therewith and leading to a flue gas collector of the boiler, a fire grate disposed at the bottom of said boiler body and formed with air passage openings communicating with said combustion chamber, said combustion chamber comprises a horizontally extending hollow body closed at a rear end and having an approximately elliptical cross-section with a vertical major diameter tapering downwards approximately conically to said fire grate, the cross-section of said hollow body below said fire grate transfering into an ash space of box form, a first ancillary heating passage of rectangular cross-section arranged axially parallel to and above said combustion chamber in the boiler water region and communicating with a forward end of said combustion chamber, said first ancillary heating passage having a large cross-sectional width extending horizontally and said first ancillary heating passage having vertically directed ribbing of comb-type cross-section disposed inside said first ancillary heating passage, said burner chamber comprises a horizontally extending round cylinder closed at a rear end, a longitudinal center line of said burner chamber being substantially at the level of a longitudinal center line of said combustion chamber, a second ancillary heating passage of rectangular cross-section arranged axially parallel to and above said burner chamber in the boiler water region and communicating with a forward end of said burner chamber, said second ancillary heating passage having a larger cross-sectional width extending horizontally and said second ancillary heating passage having vertically directed ribbing of comb-type cross section disposed inside second ancillary heating passage, said outer boiler body comprising a metal sheet shaped in one piece by rolling into a hollow body having a noncircular round-like cross-section comprising an upper curve portion, a lower curve portion and two lateral curve portions constituting four curve portions, three transition curve portions having smaller radii of curvature than said four curve portions, said upper, said lower and said lateral curve portions merging into one another above said two chambers and below said burner chamber via said three transition curve portions, one of said lateral curve portions being laterally adjacent said combustion chamber and the other of said lateral curve portions being laterally adjacent said burner chamber, said lower curve portion and said one of said lateral curve portions terminating at the ash space of said combustion chamber, and the height of said other of said lateral curve portions being less than the height of said one of said lateral curve portions.

2. The two-chamber boiler according to claim 1, wherein said ribbings of said ancillary heating passages each have a rib base connected with a wall of said passages and a rib apex protruding into the cross-section of said passages, the height from said rib base to said apex being between 35 and 45 mm and the thickness of each said ribbing being substantially 2.5 mm.

3. The two-chamber boiler according to claim 2, wherein said height is between 40 to 41 mm.

4. The two-chamber boiler according to claim 1, further comprising guide walls arranged on both sides in said combustion chamber extend spaced from a wall of said combustion chamber upwardly from said fire grate into an upper region of said combustion chamber and define interspaces between said guide walls and the wall of said combustion chamber in communication with air supply to said combustion chamber, said interspaces constituting secondary air preheating passages.

5. The two-chamber boiler according to claim 3, further comprising slide plate means disposed in a region of said fire grate between said guide walls, said slide plate means for varying the cross-section of said air passage openings of said fire grate by displacement of said slide plate means in a longitudinal direction of said combustion chamber.

6. The two-chamber boiler according to claim 1, wherein said outer boiler body is formed in a region of one of said transition curve portions between said upper curve portion and said other lateral curve portion with an opening, a hood having an approximately triangular cross-section is fitted on said outer boiler body at said opening, said hood comprises boiler connections entering said boiler water space.

* * * * *